US008353418B2

(12) United States Patent
Bork

(10) Patent No.: US 8,353,418 B2
(45) Date of Patent: Jan. 15, 2013

(54) PRESSURE RELIEF CAP

(75) Inventor: Kevin W. Bork, Germantown, WI (US)

(73) Assignee: Bemis Manufacturing Company, Sheboygan Falls, WI (US)

( * ) Notice: Subject to any disclaimer, the term of this patent is extended or adjusted under 35 U.S.C. 154(b) by 382 days.

(21) Appl. No.: 12/842,234

(22) Filed: Jul. 23, 2010

(65) Prior Publication Data

US 2012/0018430 A1 Jan. 26, 2012

(51) Int. Cl.
*B65D 51/16* (2006.01)

(52) U.S. Cl. ..... 220/203.26; 220/203.28; 220/203.07; 220/203.01; 220/303

(58) Field of Classification Search ..... 137/613; 220/203.04, 203.05, 203.07, 203.19, 203.22, 220/203.24, 203.23, 203.28, 231, 303, DIG. 32, 220/DIG. 33
See application file for complete search history.

(56) References Cited

U.S. PATENT DOCUMENTS

| | | | | |
|---|---|---|---|---|
| 2,591,562 A | | 4/1952 | Levell | |
| 2,874,867 A | | 11/1953 | Schultz | |
| 2,968,421 A | * | 1/1961 | Eshbaugh | 220/301 |
| 2,990,971 A | * | 7/1961 | Enell | 220/203.07 |
| 3,061,138 A | | 10/1962 | Edelmann et al. | |
| 3,203,445 A | * | 8/1965 | McCormick | 137/493.4 |
| 3,587,912 A | * | 6/1971 | Nagoya | 220/231 |
| 3,715,049 A | | 2/1973 | McMullen et al. | |
| 3,918,606 A | | 11/1975 | Keller | |
| 4,113,138 A | * | 9/1978 | Fields et al. | 220/361 |
| 4,267,858 A | | 5/1981 | Lewis | |
| 4,466,550 A | | 8/1984 | Sullivan | |
| 4,676,390 A | | 6/1987 | Harris | |
| 4,679,424 A | * | 7/1987 | Tubman | 73/45.8 |
| 4,688,591 A | | 8/1987 | Edson | |
| 4,736,863 A | | 4/1988 | Harris | |

(Continued)

FOREIGN PATENT DOCUMENTS

EP 0097443 A1 4/1984

(Continued)

OTHER PUBLICATIONS

Admitted Prior Art—Kelch Ratchet Cap, a Division of Bemis Manufacturing Company, offered for sale in the U.S. more than one year prior to Jul. 23, 2010.

*Primary Examiner* — Anthony Stashick
*Assistant Examiner* — Chetan Chandra
(74) *Attorney, Agent, or Firm* — Michael Best & Friedrich LLP

(57) ABSTRACT

A pressure relief cap engageable with a container includes a vent passage between an interior of the cap and an exterior of the cap. A two-way pressure relief valve is located along the vent passage and is configured to open automatically in response to a positive net interior pressure exceeding a first threshold pressure and in response to a negative net interior pressure exceeding a second threshold pressure. A manual actuator is actuable from the exterior of the cap to open the two-way pressure relief valve. A plug is positioned along the vent passage in series with the two-way pressure relief valve, movable between a first position in which the vent passage is open between the two-way pressure relief valve and the exterior of the cap and a second position in which the plug closes the vent passage between the two-way pressure relief valve and the exterior of the cap.

20 Claims, 6 Drawing Sheets

U.S. PATENT DOCUMENTS

| | | | | |
|---|---|---|---|---|
| 4,779,755 | A | 10/1988 | Harris | |
| 4,787,529 | A | 11/1988 | Harris | |
| 4,795,050 | A | 1/1989 | Smith et al. | |
| 4,796,777 | A | 1/1989 | Keller | |
| 4,830,213 | A * | 5/1989 | Sleder | 220/203.19 |
| 4,886,089 | A | 12/1989 | Gabrlik et al. | |
| 4,887,733 | A | 12/1989 | Harris | |
| 4,905,863 | A | 3/1990 | Blomquist et al. | |
| 5,020,685 | A | 6/1991 | Sato et al. | |
| 5,027,844 | A | 7/1991 | Forsythe et al. | |
| 5,108,001 | A | 4/1992 | Harris | |
| 5,169,015 | A | 12/1992 | Burke | |
| 5,183,173 | A | 2/1993 | Heckman | |
| RE34,238 | E | 5/1993 | Gabrlik et al. | |
| 5,242,072 | A | 9/1993 | Koebernik | |
| 5,325,882 | A | 7/1994 | Forsythe et al. | |
| 5,520,300 | A | 5/1996 | Griffin | |
| 5,540,347 | A | 7/1996 | Griffin | |
| 5,794,806 | A | 8/1998 | Harris et al. | |
| RE36,959 | E | 11/2000 | Griffin | |
| 6,209,745 | B1 | 4/2001 | Jansson | |
| 6,223,923 | B1 | 5/2001 | Fishman | |
| 6,296,135 | B1 * | 10/2001 | Anderson et al. | 220/203.23 |
| 6,648,160 | B2 | 11/2003 | Hotch | |
| 6,814,097 | B2 | 11/2004 | Girouard | |
| 7,131,469 | B2 | 11/2006 | Dunkle | |
| 7,353,965 | B2 * | 4/2008 | Reutter | 220/303 |
| 2003/0183632 | A1 * | 10/2003 | Reutter | 220/203.23 |
| 2004/0099668 | A1 * | 5/2004 | Reutter | 220/303 |
| 2005/0051550 | A1 | 3/2005 | Hagano | |
| 2006/0054623 | A1 | 3/2006 | Hagano | |
| 2007/0060825 | A1 * | 3/2007 | Newman et al. | 600/498 |
| 2008/0000906 | A1 | 1/2008 | Nicosia et al. | |

FOREIGN PATENT DOCUMENTS

| | | | |
|---|---|---|---|
| JP | 398860 | | 4/1991 |
| JP | 2005053432 | A | 3/2005 |
| NZ | 521340 | A | 4/2003 |
| WO | 9205084 | | 4/1992 |

* cited by examiner

PRESSURE RELIEF CAP

BACKGROUND

The present invention relates to caps for containers. More particularly, the invention relates to caps with controllable pressure relief means.

SUMMARY

In one embodiment, a pressure relief cap may generally include a body defining an attachment structure configured to sealingly engage with a container, a vent passage selectively providing fluid communication through the pressure relief cap between an interior of the pressure relief cap and an exterior of the pressure relief cap, a two-way pressure relief valve located along the vent passage and configured to open automatically in response to a positive net interior pressure exceeding a first threshold pressure and in response to a negative net interior pressure exceeding a second threshold pressure, a manual actuator actuable from the exterior of the pressure relief cap to open the two-way pressure relief valve, and a plug positioned along the vent passage in series with the two-way pressure relief valve, the plug being movable between a first position, in which the vent passage is open between the two-way pressure relief valve and the exterior of the pressure relief cap, and a second position, in which the plug closes the vent passage between the two-way pressure relief valve and the exterior of the pressure relief cap.

In another embodiment, a pressure relief cap may generally include a body defining an attachment structure configured to sealingly engage with a container, a vent passage selectively providing fluid communication through the pressure relief cap between an interior of the pressure relief cap and an exterior of the pressure relief cap, a pressure relief valve located along the vent passage and configured to open automatically in response to at least one of a positive net interior pressure and a negative net interior pressure exceeding a prescribed threshold, a manual actuator actuable from the exterior of the pressure relief cap to open the pressure relief valve, the manual actuator forming at least a portion of the vent passage, and a plug threadably engaged with the manual actuator and positioned in series with the pressure relief valve along the vent passage, the plug being threadably movable between a first position, in which the vent passage is open between the two-way pressure relief valve and the exterior of the pressure relief cap, and a second position, in which the plug closes the vent passage between the two-way pressure relief valve and the exterior of the pressure relief cap.

In yet another embodiment, a pressure relief cap may generally include a body defining an attachment structure configured to sealingly engage with a container, a vent passage selectively providing fluid communication through the pressure relief cap between an interior of the pressure relief cap and an exterior of the pressure relief cap, a two-way pressure relief valve located along the vent passage and configured to open automatically in response to a positive net interior pressure exceeding a first threshold pressure and in response to a negative net interior pressure exceeding a second threshold pressure, the first threshold pressure exceeding the second threshold pressure in magnitude, a manual actuator actuable from the exterior of the pressure relief cap to open the two-way pressure relief valve by selectively displacing the second valve member from a sealed position to an open position, the manual actuator forming at least a portion of the vent passage, and a plug being threadably engaged with the manual actuator and positioned in series with the two-way pressure relief valve along the vent passage, the plug being threadably movable between a first position, in which the vent passage is open between the two-way pressure relief valve and the exterior of the pressure relief cap, and a second position, in which the plug closes the vent passage between the two-way pressure relief valve and the exterior of the pressure relief cap.

Other independent aspects of the invention will become apparent by consideration of the detailed description, claims and accompanying drawings.

DETAILED DESCRIPTION

Before any independent embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
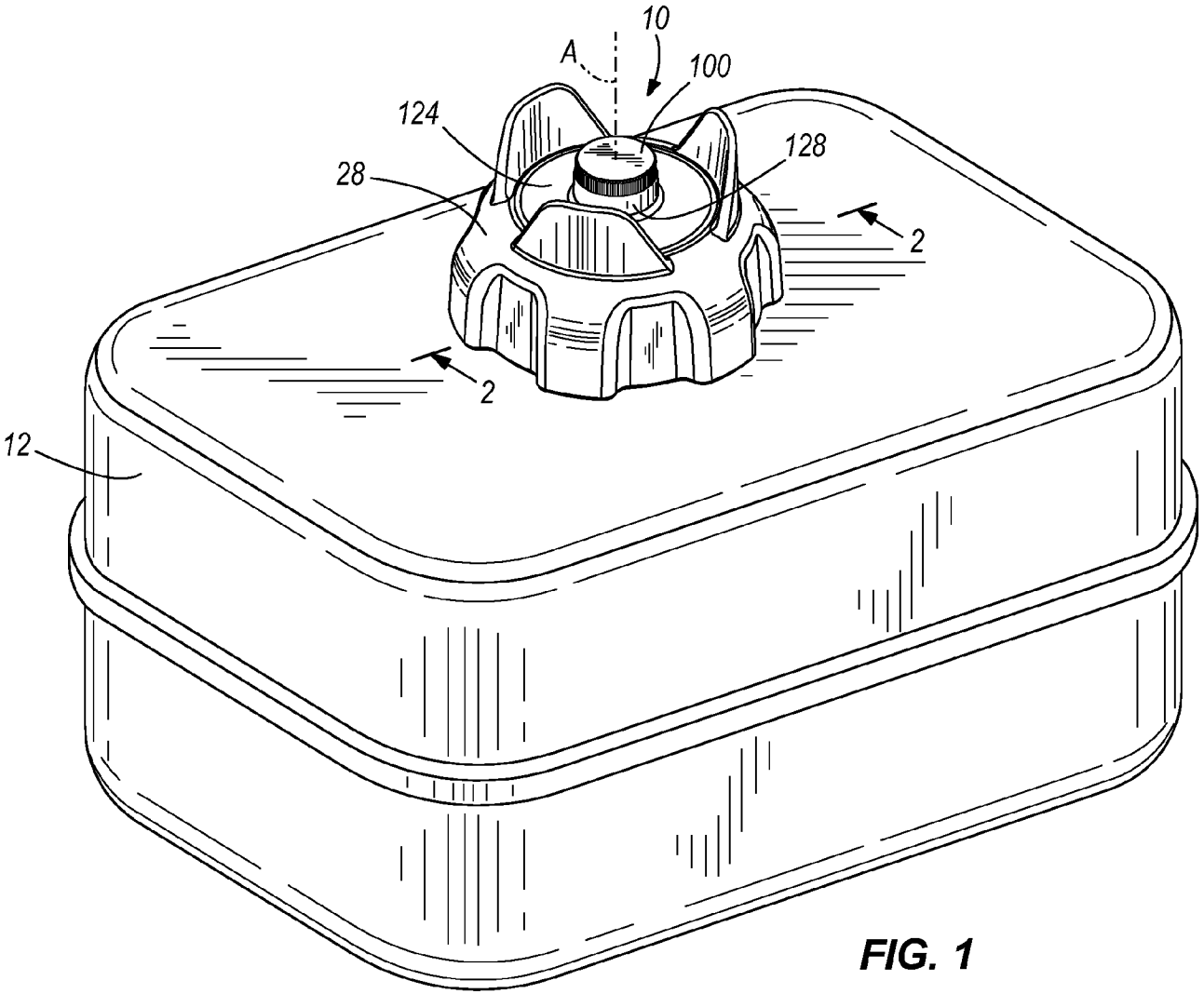
FIG. 1 is a perspective view of a pressure relief cap sealingly engaged with the opening of a container.

FIGS. 1-6 illustrate a pressure relief cap 10. FIG. 1 further illustrates a container 12 to which the cap 10 is releasably attachable to sealingly enclose the contents of the container 12. In some constructions, the container 12 is a standalone fuel tank or a fuel tank mounted in or on a vehicle or a piece of power equipment. However, the cap 10 may be used as illustrated or in a modified form in conjunction with virtually any container, regardless of the container configuration or desired contents, to manage pressure in the container 12.

The cap 10 includes a body 16 provided with an attachment structure for engaging the container 12. In the illustrated construction, the attachment structure includes internal or female threads 20 centered about an axis A of the cap 10 and configured to engage external or male threads on a coaxial opening (not shown) of the container 12. The cap 10 further includes a seal ring 24 adjacent the threads 20 configured to sealingly engage with the opening of the container 12 when the cap 10 is threadably engaged.

An outer cover 28 is provided over the body 16 and provides an external surface by which a user may grasp and rotate the cap 10 to install and remove the cap 10 from the container 12. Installation and removal torque applied to the outer cover 28 is not transmitted directly to the body 16. Rather, torque from the outer cover 28 is transmitted to the body 16 through a ratchet arrangement including a ratcheting pawl 32 engaging ratchet teeth or fingers (not shown) to limit torque applied to the body 16 in the cap-installation direction. A dust seal 36 is also provided between the outer cover 28 and the body 16.

A valve housing 40 is coupled to the body 16 and substantially encloses a pressure relief valve 44. In the illustrated construction, the valve housing 40 is securely bonded and sealed to an interior side of the body 16. For example, the valve housing 40 may be spin-welded together with the body 16, although other means may be used to couple the valve housing 40 and the body 16 together or they may be jointly formed together as portions of a single piece. The valve housing 40 has a substantially closed interior-facing axial end 40A and a substantially open exterior-facing axial end 40B. A cover member 48 is positioned over the exterior-facing axial end 40B. Like the body 16 and the valve housing 40, the cover member 48 and the valve housing 40 are securely bonded and sealed together by spin-welding or another fastening means or can be jointly formed together as portions of a single piece. The cover member 48 includes a central axially-oriented aperture 50, described in further detail below.

Figure 2:
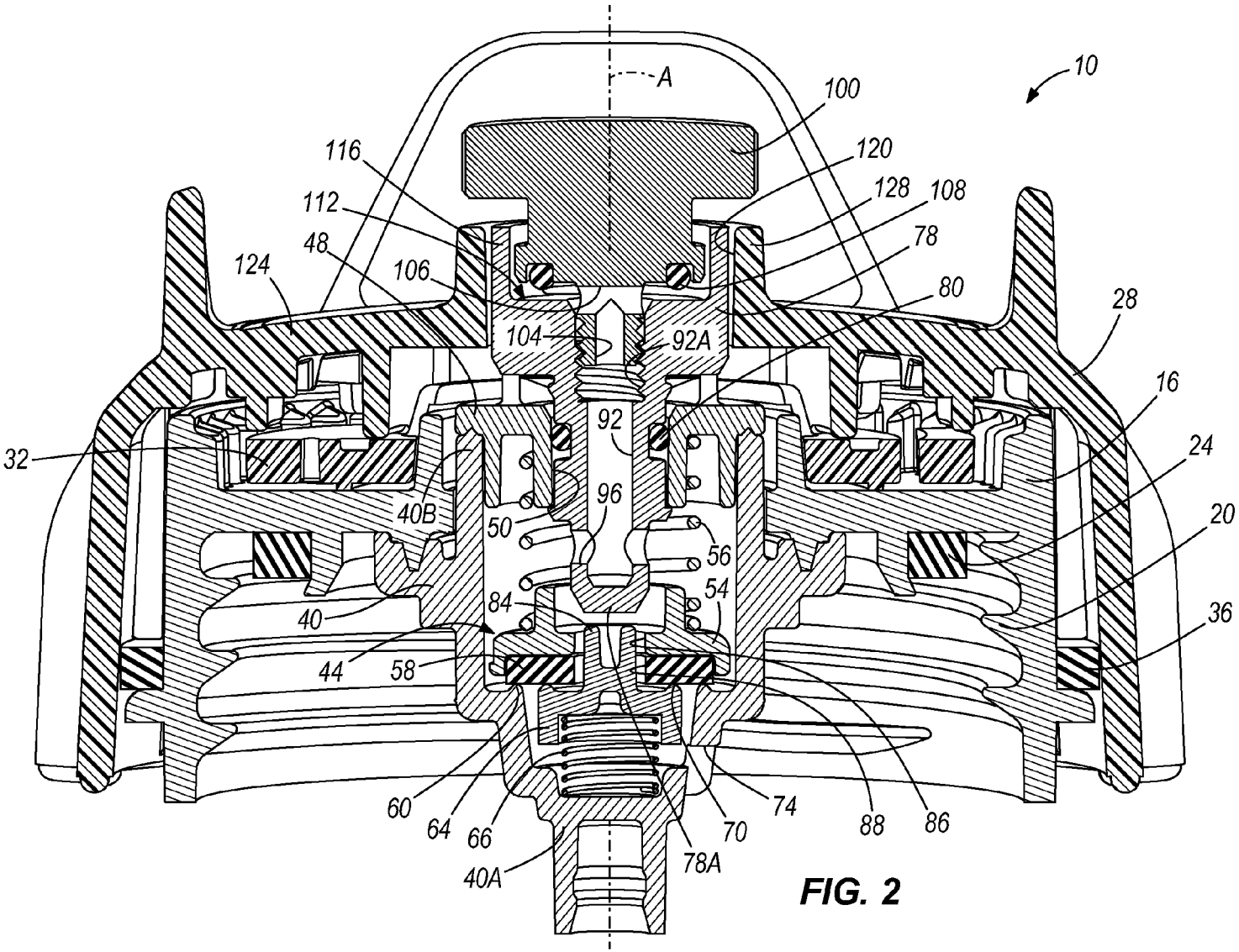
FIG. 2 is a cross-section of the pressure relief cap, taken generally along line 2-2 of FIG. 1.

The pressure relief valve 44 is a two-way pressure relief valve capable of automatically relieving both a positive net interior pressure exceeding a first threshold pressure and a negative net interior pressure exceeding a second threshold pressure. In the illustrated construction, the pressure relief valve 44 includes a first valve member 54 biased in an axially inward direction by a first spring 56. A seal ring 58 is carried with the first valve member 54 and pressable into contact with a sealing ridge 60 of the valve housing 40. A second valve member 64 is biased in the axially outward direction by a second spring 66. The second valve member 64 is formed with a sealing ridge 70 that is pressable into contact with the seal ring 58. Under zero net pressure across the pressure relief valve 44, the valve members 54, 64 are positioned as shown in FIG. 2 (in a valve closed condition).

The first spring 56 provides a stronger biasing force than the second spring 66 so that the seal ring 58 remains pressed and sealed against the sealing ridge 60 although the second spring 66 exerts a force tending to lift the first valve member 54 and the seal ring 58 away from the sealing ridge. Due at least in part to the difference in spring bias, the magnitude of the first threshold pressure is greater than the second threshold pressure. At least one aperture 74 is provided near the interior-facing axial end 40A of the valve housing 40 to establish fluid communication between the interior side of the cap 10 and the pressure relief valve 44. The aperture 74 is small in size so that the pressure of the contents of the container 12 is communicated freely with the interior of the valve housing 40 while limiting the potential intrusion of liquid contents into the valve housing 40. As described in detail below, the pressure relief valve 44 is also in fluid communication with the exterior side of the cap 10.

As described above, the pressure relief valve 44 is configured to equalize the pressure on the interior and exterior sides of the cap 10 by responding automatically to net pressure differentials exceeding prescribed thresholds. However, the cap 10 also includes structure or means for manually actuating the pressure relief valve 44 to equalize the pressure across the cap 10 on demand. A manual actuator 78 is sealingly received in the aperture 50 of the cover member 48 on the valve housing 40 with a seal member (e.g., O-ring 80). The manual actuator 78 is axially movable with respect to the valve housing 40 and the cover member 48 while maintaining the sealed relationship with the cover member 48. As described in further detail below, an axially inward tip 78A of the manual actuator 78 is configured for engagement with a projection 84 of the second valve member 64. In the illustrated construction, the projection 84 of the second valve member 64 extends axially through respective central axial apertures 86, 88 in the first valve member 54 and the seal ring 58, both of which are annular or ring-shaped.

Regardless of whether the pressure relief valve 44 is actuated automatically or manually, a vent passage must be defined through the cap 10 in order for the pressure relief valve 44 to effectively equalize the pressure between the interior and exterior. In the illustrated construction, the pressure relief valve 44 is positioned along a vent passage that is formed at least in part by the valve housing aperture 74 and the interior cavity of the valve housing 40. However, the manual actuator 78 also forms at least a part of the vent passage. A primary bore 92 extends axially from an exterior end through a majority of the axial length of the manual actuator 78. The axially interior end is closed, but a transverse bore 96 provides fluid communication between the inside of the valve housing 40 and the primary bore 92. Thus, both of the bores 92, 96 in the manual actuator 78 also form portions of the vent passage through the cap 10.

Although, in some constructions, the manual actuator 78 can be exposed to and directly actuated from the exterior of the cap 10, the manual actuator 78 is actuated via a plug 100 in the illustrated construction. The plug 100 is a screw plug in the illustrated construction and is threadably engaged with a threaded portion 92A of the primary bore 92 in the manual actuator 78. The plug 100 is thus positioned along the vent passage between the pressure relief valve 44 and the exterior of the cap 10. The plug 100 can be used to selectively close the vent passage, as described in further detail below.

The plug 100 includes intersecting axial and transverse bores 104, 106 that form a portion of the vent passage and establish fluid communication between the exterior of the cap 10 and the primary bore 92 of the manual actuator 78 when the plug 100 is a first or open position (shown in FIGS. 2-5). However, the plug 100 can be screwed into the threaded portion 92A of the manual actuator 78 to a second position (shown in FIG. 6) to close the vent passage by compressing a seal member (e.g., O-ring 108) on the plug 100 against an axial face 112 of the manual actuator 78. When the plug 100 is in the second position, the operation of the pressure relief valve 44 is prevented and pressure cannot be equalized across the cap 10. Thus, the plug 100 adds to the functionality of the cap 10 by acting as an on/off control for the pressure relief valve 44. Furthermore, the plug 100 can act as a throttling device that provides a variable restriction in the vent passage when the plug 100 is moved to positions between the first position and the second position. Thus, the rate of flow through the vent passage during a pressure relief event can be varied according to the position of the plug 100.

An upstanding circumferential wall 116 is formed at the axially outer end of the manual actuator 78 to form a recess or bowl that receives and shields the O-ring 80 and the associated portion of the plug 100. The manual actuator 78 and the plug 100 extend through an aperture 120 in a crown 124 of the outer cover 28. In the illustrated construction, the aperture 120 is centrally located about the axis A of the cap 10. The crown 124 includes an upstanding circumferential wall 128 that coaxially bounds the upstanding circumferential wall 116 of the manual actuator 78 and extends axially to about the same height.

Figure 3:
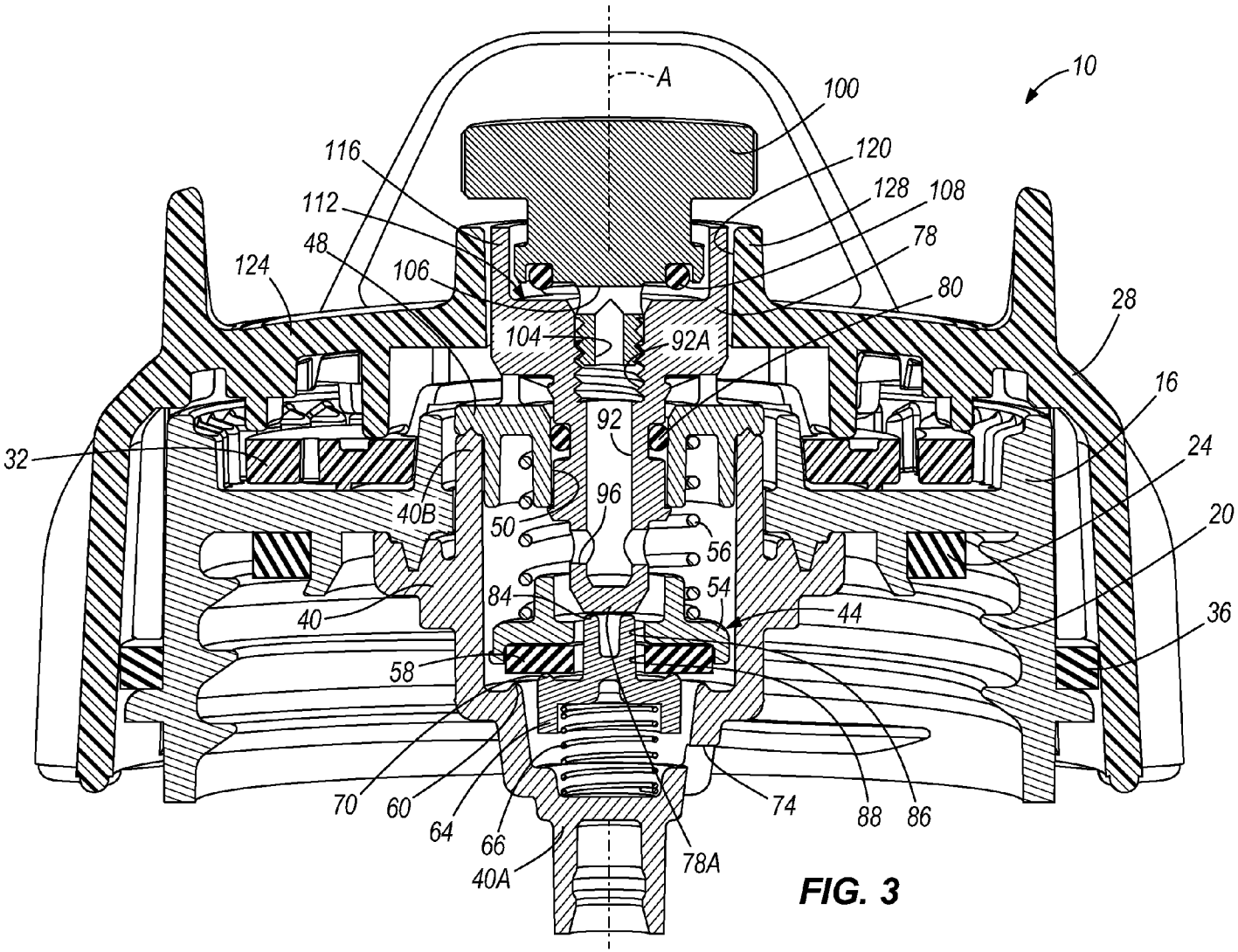
FIG. 3 is a cross-section similar to FIG. 2, illustrating the pressure relief cap in a state in which a positive net interior pressure is automatically relieved by a pressure relief valve.

Operation of the cap 10 will now be described in detail. When the plug 100 is open, when a positive net interior pressure exceeds the first threshold pressure (e.g., a pressure of 1.0 psi, 3.5 psi, 5.0 psi, or 15 psi), the positive net interior pressure exerts a force on the second valve member 64 and the seal ring 58 that is sufficient to overcome the bias of the first spring 56. Thus, the force resulting from the positive net interior pressure causes the seal ring 58 to be lifted off of the sealing ridge 60 as shown in FIG. 3. When this occurs, the positive net interior pressure is relieved through the vent passage to the exterior of the cap 10. In the illustrated embodiment, the positive net interior pressure is relieved from the valve housing 40, through the transverse and primary bores 96, 92 of the manual actuator 78, through the intersecting bores 104, 106 of the plug 100, and out to the exterior of the cap 10 through the gap between the upstanding circumferential wall 116 and the periphery of the plug 100.

Figure 4:
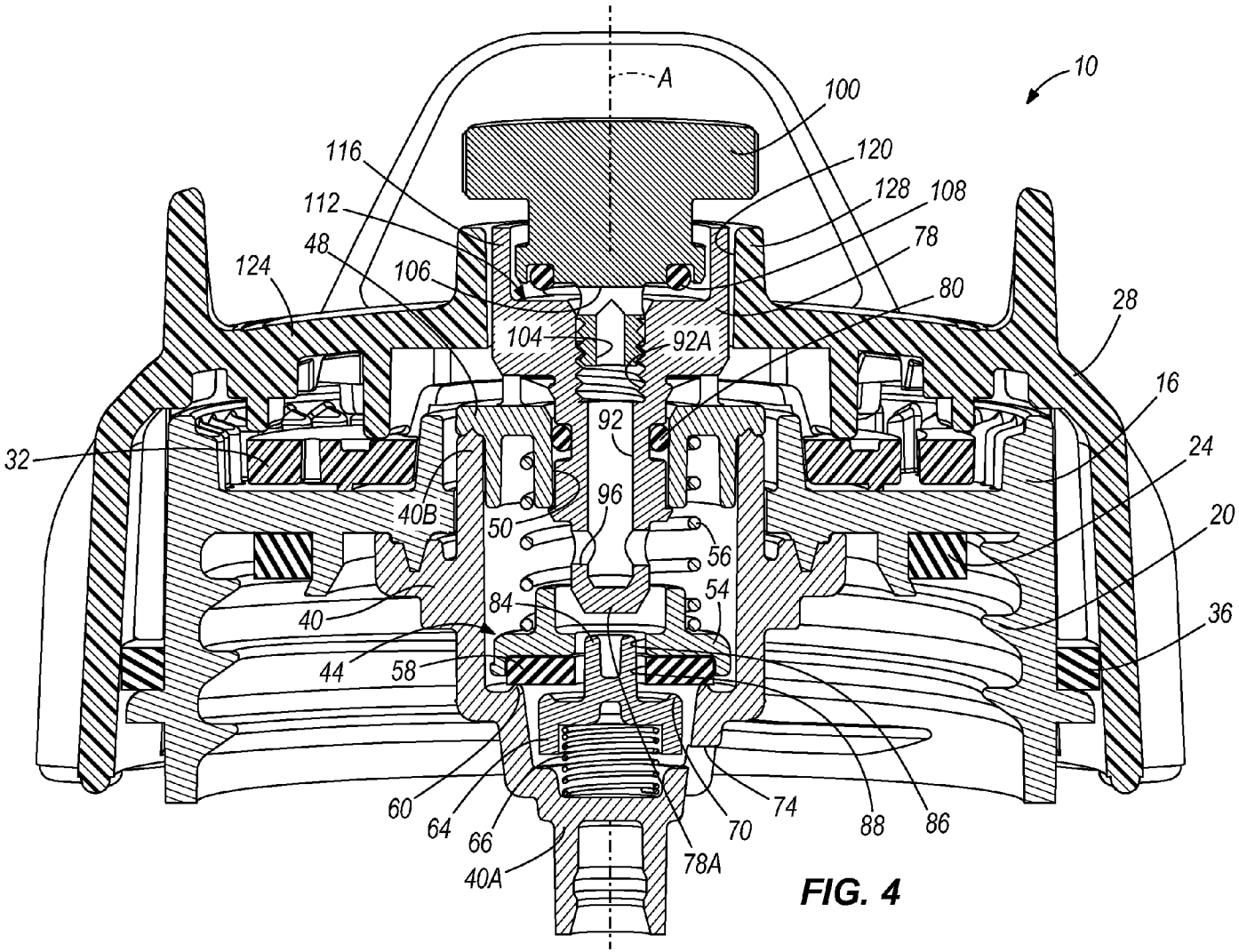
FIG. 4 is a cross-section similar to FIG. 2, illustrating the pressure relief cap in a state in which a negative net interior pressure is relieved by a pressure relief valve.

When the plug 100 is open and when a negative net interior pressure exceeds the second threshold pressure, the positive net atmospheric pressure on the exterior of the cap 10 is sufficient to exert a force on the second valve member 64 that is sufficient to overcome the bias of the second spring 66. The resulting force from the positive net atmospheric pressure causes the sealing ridge 70 to be lifted off of the seal ring 58 as shown in FIG. 4. When this occurs, the atmospheric pressure on the exterior of the cap 10 relieves the negative net interior pressure on the interior of the cap 10 through the vent passage. In the illustrated embodiment, the negative net interior pressure is relieved along a path that is the direct reverse of the path by which the positive net interior pressure is relieved. In some constructions, the second threshold pressure is made as small as reasonably possible so that the build-up of negative net interior pressure is substantially prevented. For example, the magnitude of the second threshold pressure may be 1.0 psi or less (e.g., 0.25 psi, 0.33 psi, 0.5 psi).

Figure 5:
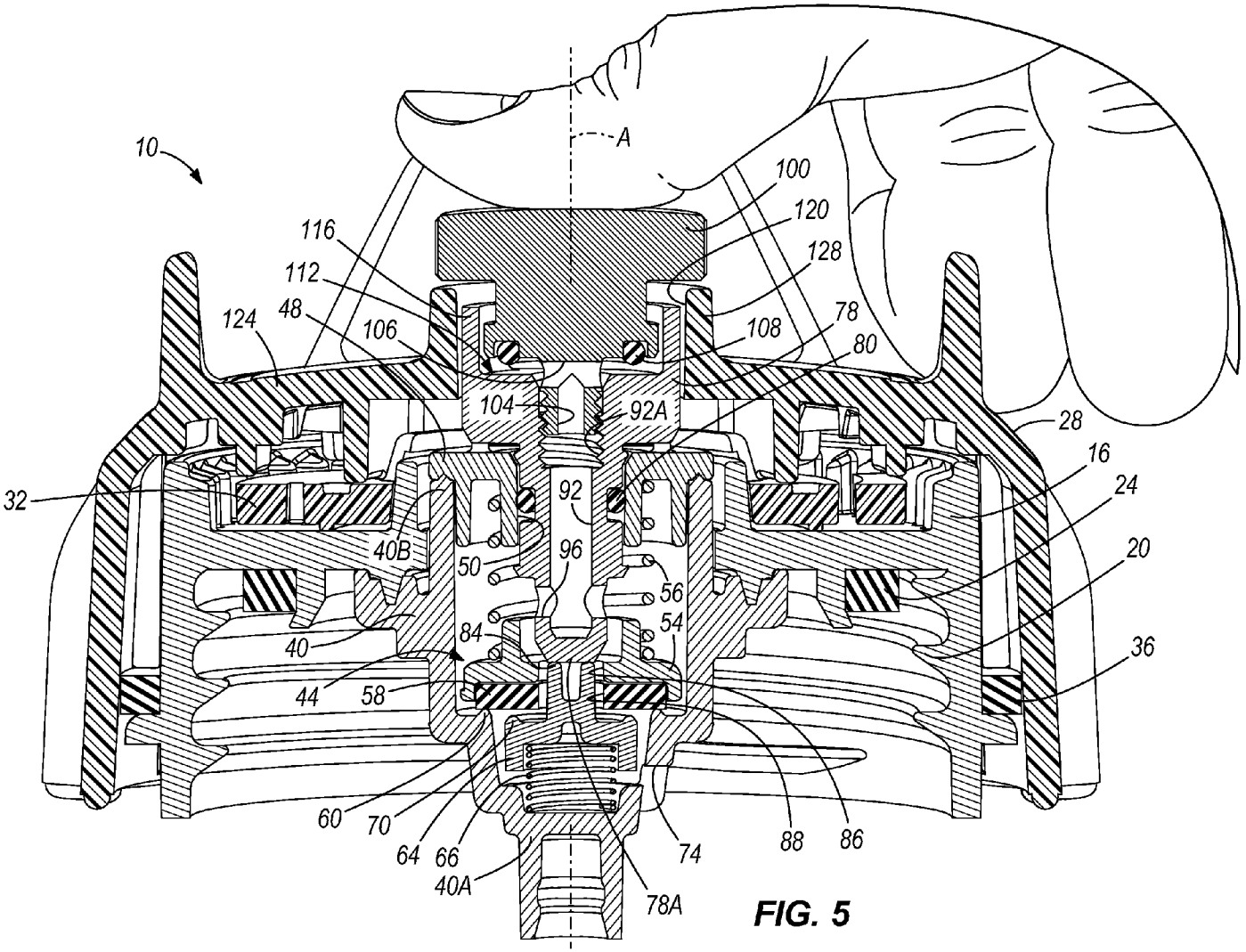
FIG. 5 is a cross-section similar to FIG. 2, illustrating manual actuation of the pressure relief valve for on-demand venting of a net pressure differential between the interior and exterior sides of the pressure relief cap.
Figure 6:
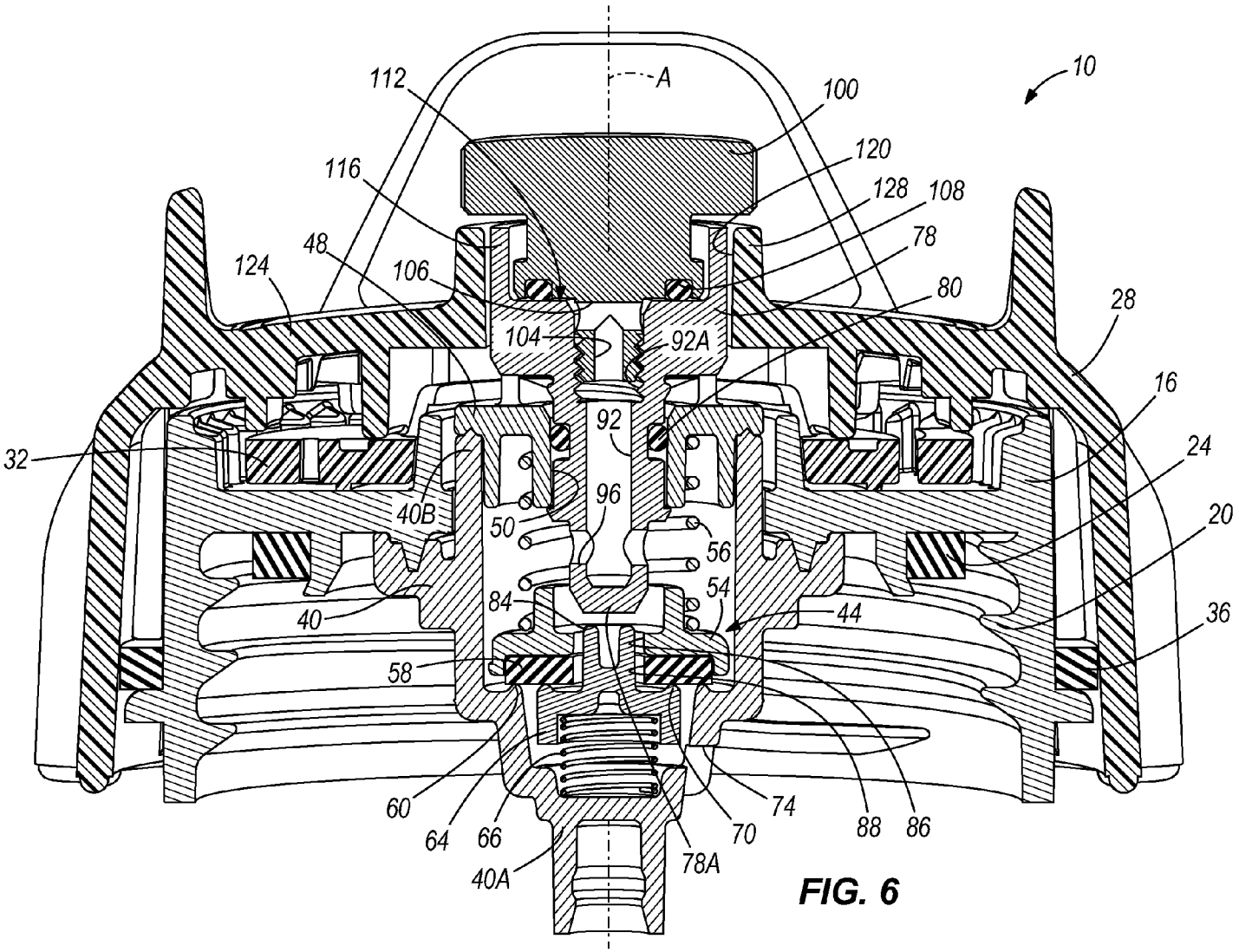
FIG. 6 is a cross-section similar to FIG. 2, illustrating the closure of a plug to block a vent passage between the pressure relief valve and the exterior of the pressure relief cap.

As described above, the manual actuator 78 enables a user to equalize pressure across the cap 10 at any time (when the plug 100 is open), regardless of the magnitude of the net pressure differential across the cap 10. To manually vent the cap 10, the user presses on the plug 100 which, by virtue of the threaded engagement between the plug 100 and the manual actuator 78, axially moves the manual actuator 78 (toward the interior side). The manual actuator 78 physically engages a portion of the pressure relief valve 44 to simulate the valve's reaction to a pressure differential exceeding a threshold pressure (e.g., the second threshold pressure). When the manual actuator 78 is fully depressed, the axially inward tip 78A of the manual actuator 78 contacts the projection 84 of the second valve member 64 and opens the pressure relief valve 44 by breaking the seal between the second valve member 64 and the seal ring 58 as shown in FIG. 5. Thus, any pressure differential can be equalized through the vent passage. It should be noted that, because the manual actuator 78 physically actuates the pressure relief valve rather than forming an alternate or parallel vent passage, the plug 100 must be open in order to manually vent the cap 10. As such, the single plug 100, when closed (see FIG. 6), is effective at preventing both automatic venting and manual venting of net pressure across the cap 10.

However, the plug 100 may also be configurable to allow automatic operation of the pressure relief valve 44 while preventing manual actuation. The distance between the axially outer end of the wall 128 on the outer cover 28 and the overlying portion of the plug 100 may be sufficiently small when the plug 100 is screwed partially into the manual actuator 78 to limit the axial movement of the plug 100 and the manual actuator 78 so that the tip 78A of the manual actuator 78 is prevented from moving the second valve member 64. In some constructions, the tip 78A of the manual actuator 78 may even be prevented from contacting the second valve member 64 by abutment between the plug 100 and the outer cover 28.

Various features and advantages of the invention are set forth in the following claims.

What is claimed is:

1. A pressure relief cap comprising:

a body defining an attachment structure configured to sealingly engage with a container;

a vent passage selectively providing fluid communication through the pressure relief cap between an interior of the pressure relief cap and an exterior of the pressure relief cap;

a two-way pressure relief valve located along the vent passage and configured to open automatically in response to a positive net interior pressure exceeding a first threshold pressure and in response to a negative net interior pressure exceeding a second threshold pressure;

a manual actuator actuable from the exterior of the pressure relief cap to open the two-way pressure relief valve; and a plug positioned along the vent passage in series with the two-way pressure relief valve, the plug being movable between a first position, in which the vent passage is open between the two-way pressure relief valve and the exterior of the pressure relief cap, and a second position, in which the plug closes the vent passage between the two-way pressure relief valve and the exterior of the pressure relief cap.

2. The pressure relief cap of claim 1, wherein the plug is a screw plug threaded into the vent passage.

3. The pressure relief cap of claim 1, wherein the plug is threaded into a portion of the vent passage provided in the manual actuator.

4. The pressure relief cap of claim 1, wherein the vent passage closable by the plug is the only vent passage between the two-way pressure relief valve and the exterior of the pressure relief cap such that, when the plug is in the second position, equalization of pressures on the interior and exterior sides of the cap via the two-way pressure relief valve cannot be achieved automatically and cannot be achieved manually.

5. The pressure relief cap of claim 1, wherein the body is formed with threads providing the attachment structure, and wherein the pressure relief cap further comprises an outer cover coupled to the body with a ratcheting pawl that limits installation torque.

6. The pressure relief cap of claim 5, wherein the threads formed in the body are female threads.

7. The pressure relief cap of claim 1, wherein the magnitude of the first threshold pressure is greater than the magnitude of the second threshold pressure.

8. The pressure relief cap of claim 1, wherein the two-way pressure relief valve includes a first valve member movable in response to a positive net interior pressure exceeding the first threshold pressure and a second valve member movable in response to a negative net interior pressure exceeding the second threshold pressure, and wherein the manual actuator is movable to selectively displace the second valve member from a sealed position to an open position.

9. The pressure relief cap of claim 1, wherein the plug includes an interior passage forming at least a portion of the vent passage.

10. A pressure relief cap comprising:

a body defining an attachment structure configured to sealingly engage with a container;

a vent passage selectively providing fluid communication through the pressure relief cap between an interior of the pressure relief cap and an exterior of the pressure relief cap;

a pressure relief valve located along the vent passage and configured to open automatically in response to at least one of a positive net interior pressure and a negative net interior pressure exceeding a prescribed threshold;

a manual actuator actuable from the exterior of the pressure relief cap to open the pressure relief valve, the manual actuator forming at least a portion of the vent passage; and a plug threadably engaged with the manual actuator and positioned in series with the pressure relief valve along the vent passage, the plug being threadably movable between a first position, in which the vent passage is open between the two-way pressure relief valve and the exterior of the pressure relief cap, and a second position, in which the plug closes the vent passage between the two-way pressure relief valve and the exterior of the pressure relief cap.

11. The pressure relief cap of claim 10, wherein the pressure relief valve is a two-way pressure relief valve configured to open automatically in response to a positive net interior pressure exceeding a first threshold pressure and in response to a negative net interior pressure exceeding a second threshold pressure.

12. The pressure relief cap of claim 11, wherein the magnitude of the first threshold pressure is greater than the magnitude of the second threshold pressure.

13. The pressure relief cap of claim 11, wherein the two-way pressure relief valve includes a first valve member movable in response to a positive net interior pressure exceeding the first threshold pressure and a second valve member movable in response to a negative net interior pressure exceeding the second threshold pressure, the manual actuator being movable to selectively displace the second valve member from a sealed position to an open position.

14. The pressure relief cap of claim 10, wherein the vent passage closable by the plug is the only vent passage between the pressure relief valve and the exterior of the pressure relief cap such that, when the plug is in the second position, equalization of pressures on the interior and exterior sides of the cap via the pressure relief valve cannot be achieved automatically and cannot be achieved manually.

15. The pressure relief cap of claim 10, wherein the body is formed with threads providing the attachment structure, and wherein the pressure relief cap further comprises an outer cover coupled to the body with a ratcheting pawl that limits installation torque.

16. The pressure relief cap of claim 15, wherein the threads formed in the body are female threads.

17. The pressure relief cap of claim 10, wherein the plug includes an interior passage forming at least a portion of the vent passage.

18. A pressure relief cap comprising:

a body defining an attachment structure configured to sealingly engage with a container;

a vent passage selectively providing fluid communication through the pressure relief cap between an interior of the pressure relief cap and an exterior of the pressure relief cap;

a two-way pressure relief valve located along the vent passage and including a first valve member configured to open automatically in response to a positive net interior pressure exceeding a first threshold pressure and a second valve member configured to open automatically in response to a negative net interior pressure exceeding a second threshold pressure, the first threshold pressure exceeding the second threshold pressure in magnitude;

a manual actuator actuable from the exterior of the pressure relief cap to open the two-way pressure relief valve by selectively displacing the second valve member from a sealed position to an open position, the manual actuator forming at least a portion of the vent passage; and a plug threadably engaged with the manual actuator and positioned in series with the two-way pressure relief valve along the vent passage, the plug being threadably movable between a first position, in which the vent passage is open between the two-way pressure relief valve and the exterior of the pressure relief cap, and a second position, in which the plug closes the vent passage between the two-way pressure relief valve and the exterior of the pressure relief cap.

19. The pressure relief cap of claim 18, wherein the plug includes an interior passage forming at least a portion of the vent passage.

20. The pressure relief cap of claim 18, wherein the vent passage closable by the plug is the only vent passage between the two-way pressure relief valve and the exterior of the pressure relief cap such that, when the plug is in the second position, equalization of pressures on the interior and exterior sides of the cap via the two-way pressure relief valve cannot be achieved automatically and cannot be achieved manually.

* * * * *